United States Patent [19]

Joahino

[11] Patent Number: 4,876,486

[45] Date of Patent: Oct. 24, 1989

[54] TWO-LEAD STARTER CIRCUIT FOR A GASEOUS DISCHARGE LAMP

[75] Inventor: Fernando A. Joanino, Skokie, Ill.

[73] Assignee: Advance Transformer Co., Chicago, Ill.

[21] Appl. No.: 139,688

[22] Filed: Dec. 30, 1987

[51] Int. Cl.[4] ..... H05B 41/14

[52] U.S. Cl. ..... 315/290; 315/289; 315/DIG. 2

[58] Field of Search ..... 315/290, 289, DIG. 2

[56] References Cited

U.S. PATENT DOCUMENTS 4,415,837 11/1983 Sodini ..... 315/289

4,480,214 10/1984 Sodini ..... 315/290

4,678,968 7/1987 Lester ..... 315/290

4,695,771 9/1987 Hallay ..... 315/290

*Primary Examiner*—Eugene R. LaRoche

*Assistant Examiner*—Truc Nguyen

*Attorney, Agent, or Firm*—Steven R. Biren

[57] ABSTRACT

A two-lead starter circuit for a gaseous discharge lamp is composed of only four components, namely a capacitor, a bilateral voltage-sensitive switch, a pulse transformer and a resistor. These components are connected in a series-parallel circuit arrangement which is both more economical and more reliable than prior-art two-lead starter circuits.

2 Claims, 1 Drawing Sheet

TWO-LEAD STARTER CIRCUIT FOR A GASEOUS DISCHARGE LAMP

BACKGROUND OF THE INVENTION

The invention is in the field of lamp starter circuits, and relates more specifically to a simplified two-lead starter circuit for a gaseous discharge lamp.

Starter or ignition circuits for gaseous discharge lamps are generally well-known. For example, a basic starter circuit is shown in U.S. Pat. No. 3,917,976, while several more advanced starter circuits are shown in U.S. Pat. Nos. 4,275,337 and 4,695,771. While these starter circuits are generally satisfactory for their intended purpose, they suffer from a number of drawbacks. For example, these circuits typically require a tapped ballast or transformer winding, a sizable parts count and/or at least three external connections.

Some of these problems are overcome in U.S. Pat. No. 4,480,214, in which several embodiments of a fairly simple two-wire starter circuit are disclosed. Nevertheless, the starter circuits disclosed in U.S. Pat. No. 4,480,214 still hav a number of drawbacks. For example, these starter circuits require a minimum of five components, with a different circuit, requiring a sixth component (a choke coil) required for low-voltage operation. Additionally, because the secondary of the pulse transformer and a series capacitor are connected across the lamp, a failure in the capacitor (which is subject to a high starting voltage) would cause the secondary of the pulse transformer to be connected directly across the lamp, thus rendering it inoperative. Additional prior-art starter circuits are shown in U.S. Pat. Nos. 3,758,818 and 3,866,088.

SUMMARY OF THE INVENTION

It is therefore an object of the present invention to provide a two-lead starter circuit for a gaseous discharge lamp having a minimized parts count, and in which the same circuit configuration can be used for both high and low voltages.

It is a further object of the invention to provide a two-lead starter circuit in which the pulse transformer secondary will not be connected directly across the lamp upon the failure of a single component.

In accordance with the invention, these and other objectives are achieved by a two-lead starter circuit for a gas discharge lamp in which the pulse transformer is connected in a unique series-parallel circuit such that there is only a single current path in parallel with the lamp, and in which the pulse transformer will not be connected directly across the lamp in the event of a capacitor failure.

DESCRIPTION OF THE PREFERRED EMBODIMENTS

Figure 1:
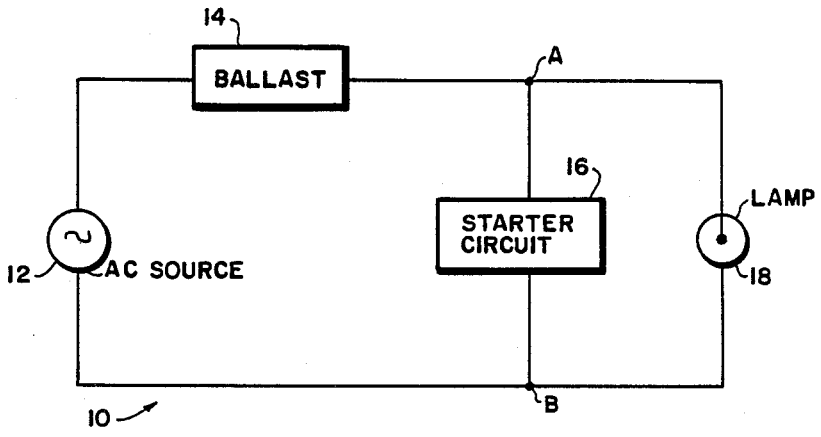
FIG.1 PRIOR ART
FIG. 1 is a block diagram of a basic prior art two-lead starter circuit for a gas discharge lamp.
Figure 2:
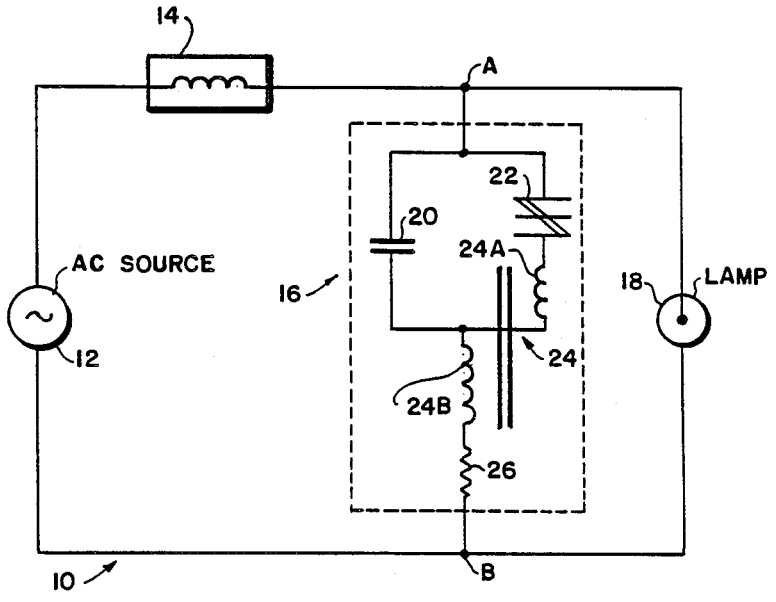
FIG. 2 is a schematic circuit diagram of a preferred embodiment of a two-lead starter circuit for a gas discharge lamp in accordance with the present invention.

FIG. 1 shows, in simplified block form, the basic components used in a lamp operating system 10 having a two-lead starter circuit. In this system, an AC source 12, which may be a 60 cycle source at a voltage of from less than 100 volts up to several hundred volts. This AC source is connected to a ballast, shown schematically as a series-connected block 14, although other types of ballast or transformer connections are clearly possible, as shown, for example in FIGS. 3–6 of the aforementioned U.S. Pat. No. 4,480,214. At the output of the ballast 14, between terminals A and B, is a starter circuit 16, connected in parallel with a lamp 18. Typical prior-art two-lead starter circuits for this application are shown in FIGS. 1 and 2 of U.S. Pat. No. 4,480,214, and lamp 18 may be a gas discharge lamp such as a high pressure sodium lamp, or other lamp type requiring a starter circuit, such as a metal halide or mercury lamp.

In accordance with the invention, FIG. 2 shows a lamp operating system 10 of the type previously described, in which the two-lead starter circuit of the invention is incorporated. In this circuit, as in FIG. 1, AC source 12 is connected through ballast 14 to the parallel combination of starter circuit 16 and lamp 18 across terminals A and B. Ballast 14 may be a reactor coil, a high-reactance autotransformer, or any other suitable type of ballast.

The starter circuit itself, shown within the dashed box 16 in FIG. 2, is composed of only four components, connected in a series-parallel arrangement requiring only two external connections. The general electrical parameters for the circuit shown in FIG. 2, such as the ignition and operating voltages of the gaseous discharge lamp 18, the magnitude of the input voltage, and the alternative configurations possible for the ballast 14 are all conventional and described in the prior-art references cited above, and are thus not described here in the interest of brevity.

The improvement of the present invention is the circuit configuration of the components located within the dashed line representing the starter circuit 16. In particular, a bilateral voltage-sensitive switch 22, such as a Sidac or other bidirectional semiconductor switching device, is connected in series with primary coil 24A of a pulse transformer 24. This transformer is of a known type, as described in the cited prior art, and may typically have a step-up turns ratio of approximately 1 to 68, in order to produce an output pulse across its secondary winding of several thousand volts, sufficient to ignite the lamp 18. This series combination of the bilateral voltage-sensitive switch 22 and the pulse transformer primary winding 24A is connected in parallel with a capacitor 20. The circuit as so far described is then connected in series with the series combination of secondary coil 24B of the pulse transformer and a resistor 26. The entire series-parallel circuit composed of the capacitor 20, the bilateral voltage-sensitive switch 22, the pulse transformer 24 and the resistor 26 is then connected across terminals A and B of the circuit shown in FIG. 2, in parallel with the gaseous discharge lamp 18.

As noted above, the circuit of FIG. 2 is capable of operating over a wide voltage range without any change in the circuit configuration. Thus, for example, circuits have been built and tested with a 55 volt high pressure sodium lamp using a capacitor 20 of between 0.47 and 0.68 microfarads, a resistor 26 of between 2.0 k ohms and 3.0 k ohms and a 120 volt Sidac for switch 22. For a 100 volt high pressure sodium lamp, the appropriate capacitor value is between 0.33 and 0.47 microfarads, while the resistor 26 is about 3 k ohms and switch 22 is a 240 volt Sidac. For a 250 volt high pressure sodium lamp, capacitor 20 may be a 0.15 microfarad capacitor, resistor 26 may be about 15 k ohms and switch 22 may be formed by two 240 volt Sidacs in series. In all of the examples described above, the pulse transformer 24 has a step-up ratio of about 1 to 68.

When the circuit of FIG. 2 is activated, the lamp 18 is initially extinguished, thus presenting a relatively high impedance load across starter terminals A and B. Accordingly, a sufficiently high voltage is generated across these terminals during a portion of the AC cycle to trigger the bilateral voltage-sensitive switch 22, thus permitting current flow through the series path of the primary and secondary of pulse transformer 24 and resistor 26. This causes the generation of an output pulse of several thousand volts across the secondary 24B of the pulse transformer, due to the high turns ratio of the transformer. Thus, a high-voltage pulse is generated in the starting circuit, and is applied to the gaseous discharge lamp 18 connected in parallel with the starting circuit across terminals A and B.

The high voltage pulse appearing across terminals A and B causes the lamp 18 to ignite, thus substantially lowering the load impedance appearing across these terminals and dropping the peak terminal voltage to less than the threshold voltage of the voltage-sensitive switch 22. At this point the switch 22 opens, thus breaking the current path to the primary winding to 24A of the pulse transformer, so that a high-voltage pulse is no longer generated by the secondary winding 24B of the pulse transformer. At this point the circuit is in its steady-state operating condition, where it will remain until the lamp is turned off. When the circuit is subsequently reactivated, the same starting and running cycles will be repeated.

As can be seen from the circuit of FIG. 2, the present invention offers several important advantages over known starter circuits. For example, the present circuit requires only four components, as compared to a minimum of five (or six for low-voltage applications) components required in the prior art circuits. In the highly-competitive field of lighting electronics, the competitive advantage of eliminating one or two components is quite substantial. Furthermore, one of the components eliminated is a capacitor, which in the prior-art circuits is subjected to high voltage, and whose failure would cause the circuit to become inoperative. Finally, the present invention offers the additional advantage that the pulse transformer is not part of the main current path during steady-state operation, so that this component can be smaller and less expensive than in prior art circuits in which the pulse transformer carries lamp current during operation.

While the invention has been particularly shown and described with reference to certain preferred embodiments thereof, it will be understood by those skilled in the art that various changes in form and detail may be made without departing from the spirit and scope of the invention.

What is claimed is:

1. A two-lead starter circuit for a gaseous discharge lamp, of the type having first and second leads connected in parallel with said lamp during operation, said starter circuit comprising a capacitor, a bilateral voltage-sensitive switch, a pulse transformer having a primary winding and a step-up secondary winding, and a resistor, said bilateral voltage-sensitive switch being connected in series with the primary winding of said pulse transformer, said capacitor being connected in parallel with the series combination of said bilateral voltage-sensitive switch and said primary winding to form a series-parallel circuit, said step-up secondary winding being connected in series with said resistor, and the series combination of said secondary winding and said resistor being connected in series with said series-parallel circuit between said first and second leads.

2. A two-lead starter circuit as claimed in claim 1, wherein the step-up ratio of said pulse transformer is about 1:68.

* * * * *